US007789703B2

(12) United States Patent
Mulfinger et al.

(10) Patent No.: US 7,789,703 B2
(45) Date of Patent: Sep. 7, 2010

(54) CONNECTOR HAVING A SHIELD ELECTRICALLY COUPLED TO A CABLE SHIELD

(75) Inventors: Robert Neil Mulfinger, York Haven, PA (US); John Joseph Consoli, Harrisburg, PA (US); Chad William Morgan, Mechanicsburg, PA (US); James Charles Shiffler, Hummelstown, PA (US); Kenneth William Ellis, Etters, PA (US); Keith McQuilkin Murr, York, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/254,990

(22) Filed: Oct. 21, 2008

(65) Prior Publication Data

US 2010/0099301 A1 Apr. 22, 2010

(51) Int. Cl.
*H01R 9/01* (2006.01)

(52) U.S. Cl. ..... 439/585; 439/581

(58) Field of Classification Search ..... 439/578–589, 439/874, 607.41; 29/860
See application file for complete search history.

(56) References Cited

U.S. PATENT DOCUMENTS

| | | | | |
|---|---|---|---|---|
| 3,600,499 | A | 8/1971 | Hibbs et al. | |
| 4,687,264 | A * | 8/1987 | Shuey | 439/92 |
| 4,895,525 | A | 1/1990 | Leonardo | |
| 5,061,827 | A | 10/1991 | Grabbe | |
| 5,380,216 | A * | 1/1995 | Broeksteeg et al. | 439/352 |
| 5,478,258 | A | 12/1995 | Wang | |
| 5,575,681 | A * | 11/1996 | Muzslay et al. | 439/459 |
| 5,580,276 | A | 12/1996 | Mussen | |
| 5,603,635 | A | 2/1997 | Delamotte et al. | |
| 5,879,190 | A * | 3/1999 | Maruyama et al. | 439/582 |
| 5,967,855 | A | 10/1999 | Asakura et al. | |
| 6,203,369 | B1 * | 3/2001 | Feldman | 439/579 |
| 6,508,668 | B1 * | 1/2003 | Yamane | 439/582 |
| 6,554,644 | B2 * | 4/2003 | Koide | 439/585 |
| 6,643,926 | B2 * | 11/2003 | Sakaguchi et al. | 29/863 |
| 6,709,290 | B2 * | 3/2004 | Yoshida | 439/585 |
| 6,739,907 | B2 * | 5/2004 | Kuroda et al. | 439/582 |
| 6,746,277 | B2 * | 6/2004 | Laub et al. | 439/585 |
| 6,840,822 | B1 * | 1/2005 | Hall et al. | 439/752.5 |
| 7,102,082 | B2 | 9/2006 | Ortiz et al. | |
| 7,414,197 | B2 | 8/2008 | Ortiz et al. | |
| 2008/0200067 | A1 * | 8/2008 | Schuster et al. | 439/581 |

* cited by examiner

*Primary Examiner*—Reene Luebke
*Assistant Examiner*—Larisa Tsukerman

(57) ABSTRACT

A connector assembly includes a cable, a connector and a resistance weld. The cable includes a conductor and a cable shield. The connector includes a contact and a shield. The shield includes conductive walls and a cradle. The walls extend from a mating interface to the cradle and at least partially surround the contact to shield the contact from electromagnetic interference. The mating interface is configured to receive a mating connector to mate the connector and mating connector. The cradle includes sidewalls interconnected by a coupling wall. The sidewalls and coupling wall extend from a loading interface toward the mating interface and are shaped to receive the cable through the loading interface. The resistance weld is between the cable shield and the cradle to electrically couple the shield to the cable shield. The shield is electrically connected to the electrical ground by the resistance weld and the cable shield.

19 Claims, 6 Drawing Sheets

CONNECTOR HAVING A SHIELD ELECTRICALLY COUPLED TO A CABLE SHIELD

BACKGROUND OF THE INVENTION

The subject matter herein relates generally to electrical connectors, and more particularly, to electrical connectors electrically coupled to an electrical ground through a cable.

Known connectors include a contact and a shield. The contact engages a mating contact to establish an electrical connection between the connector and the mating connector. The shield is electrically coupled to an electrical ground to shield the contact from electromagnetic interference. In some known connectors, the contact is electrically connected to a center conductor of a cable and the shield is electrically connected to a shield of the same cable. The center conductor in the cable electrically couples the contact in the connector with another electrical component, such as another connector or a conductive trace in a circuit board. The cable shield electrically connects the shield with an electric ground.

The electrical connection between the shield and the cable shield typically is established by crimping the shield onto the cable or using a technique referred to as Insulation Displacement Connection ("IDC"). Known cables include a protective insulating jacket that surrounds the cable shield. With crimping, the shield is bent or crimped, onto the cable. The cable includes a protective jacket that is locally stripped or removed to expose the cable shield. The shield is crimped onto the cable shield to establish the electrical connection between the shield and the cable shield. An IDC similarly requires part of the protective jacket to be stripped as the cable is inserted into the shield. Both of these techniques may result in the altering of the geometry or shape of the cable shield. For example, crimping may deform the geometry of the cable shield by reducing an outer diameter of the cable shield or by making the cable shield uneven and non-circular in the area where the cable is crimped. Altering the geometry of the cable shield may cause a change in the impedance of the cable. For example, reducing the diameter or changing the shape of the cable shield may cause a local increase, or spike, in the impedance exhibited by the cable at the location of the crimping or the IDC. Spikes in the impedance characteristic exhibited by the cable may impact the cable's ability to transmit and shield from electromagnetic interference the signals that are communicated using the cable and connector, and may increase noise in the signals.

Another known technique for coupling the shield and the cable shield involves manually soldering the shield and the cable shield together. Yet, the manual soldering of the shields may not provide, a reliable connection between the connector and cable shields. For example, human error in placing the solder may result in insufficient solder between the connector and cable shields, thereby resulting in a poor electrical connection between the connector and cable shields. A poor electrical connection between the connector and cable shields may prevent the shield from being electrically coupled to an electrical ground by the cable shield. In another example, error in the amount of heat applied to the connector and cable shields during soldering may result in insufficient thermal energy being transferred to the solder. The solder flows when heat is applied to the solder. As the solder flows, the solder fills in the voids and gaps between the connector and cable shields to electrically couple the connector and cable shields. If an insufficient amount of heat is applied to the solder, the solder may not flow enough to electrically couple the connector and cable shields.

Thus, a need exists for an improved manner of electrically and mechanically connecting a connector shield with a cable shield.

BRIEF DESCRIPTION OF THE INVENTION

In one embodiment, a connector assembly includes a cable, a connector and a resistance weld. The cable includes a conductor and a cable shield that at least partially surrounds the cable conductor. The cable shield is configured to be connected to an electrical ground. The connector includes a contact and a shield. The shield includes conductive walls and a cradle. The walls extend from a mating interface to the cradle and at least partially surround the contact to shield the contact from electromagnetic interference. The mating interface is configured to receive a mating connector to mate the connector and mating connector. The cradle includes sidewalls interconnected by a coupling wall. The sidewalls and coupling wall extend from a loading interface toward the mating interface and are shaped to receive the cable through the loading interface. The resistance weld is between the cable shield and the cradle to electrically couple the shield to the cable shield. The shield is electrically connected to the electrical ground by the resistance weld and the cable shield.

In another embodiment, a connector assembly includes a cable, a connector and a non-insulation displacement connection ("non-IDC") between the cable shield and the cradle. The cable includes a conductor and a cable shield that at least partially surrounds the cable conductor. The cable shield is configured to be connected to an electrical ground. The connector includes a contact and a shield. The shield includes conductive walls and a cradle. The walls extend from a mating interface to the cradle and at least partially surround the contact to shield the contact from electromagnetic interference. The mating interface is configured to receive a mating connector to mate the connector and mating connector. The cradle includes sidewalls interconnected by a coupling wall. The sidewalls and coupling wall extend from a loading interface toward the mating interface and are shaped to receive the cable through the loading interface. The non-IDC electrically couples the shield to the cable shield without deforming the cable shield such that an outer diameter of the cable shield is approximately the same inside the cradle and outside of the shield in a location that is proximate to the loading interface.

DETAILED DESCRIPTION OF THE INVENTION

Figure 1:
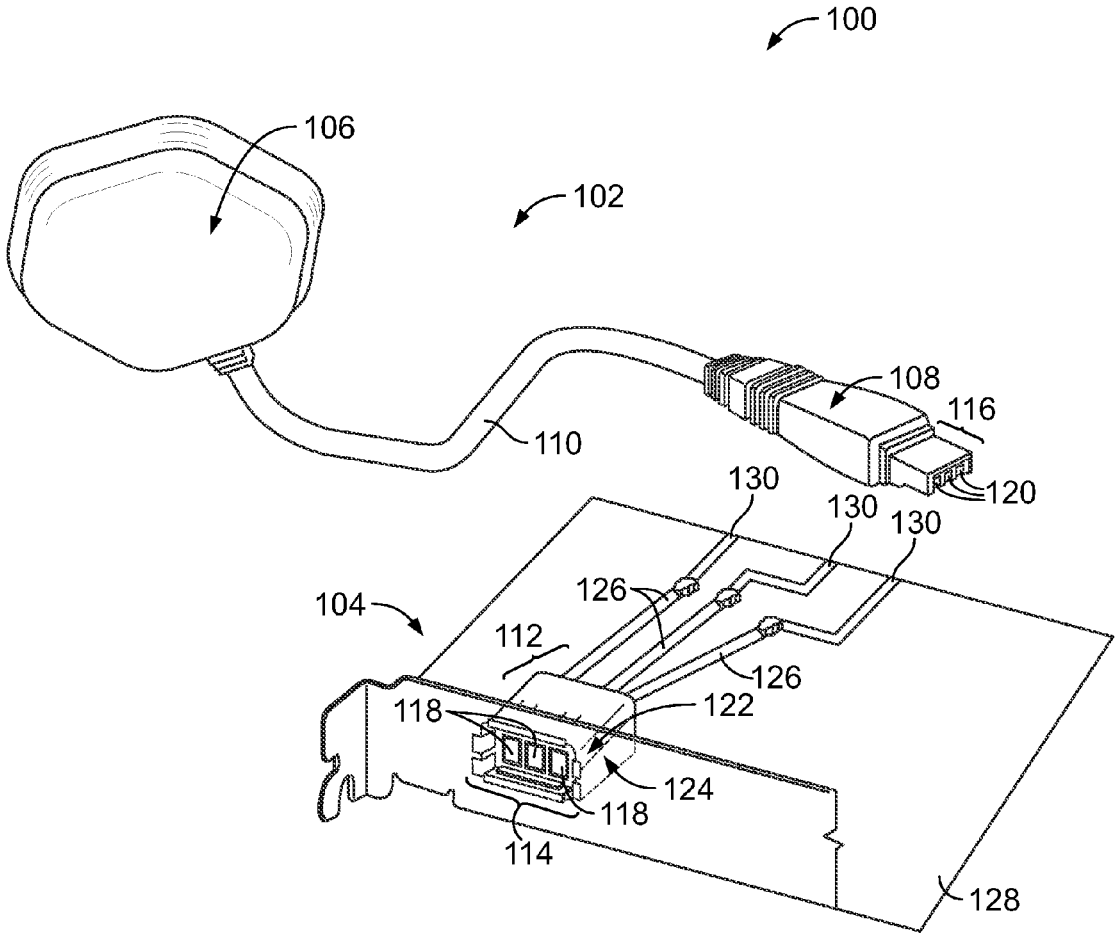
FIG. 1 is a perspective view of a connector system according to one exemplary embodiment.

FIG. 1 is a perspective view of a connector system 100 according to one exemplary embodiment. The connector system 100 includes a device assembly 102 and a connector assembly 104. The device and connector assemblies 102, 104 mate with one another to permit electrical communication between the device and connector assemblies 102, 104. The device assembly 102 includes a peripheral device 106 interconnected with a mating connector 108 by a device cable 110. In the illustrated embodiment, the device 106 is an RF antenna. In one or more other embodiments, the device 106 can include other electronic components capable of communicating with the connector assembly 104. By way of example only, the device 106 may include a mobile antenna, a Global Positioning System ("GPS") device, a radio device, a handheld computing device such as a Personal Digital Assistant ("PDA"), a mobile phone, an automotive telematic device, a WiFi device, a WiMax device, a data device, and the like. The device cable 110 communicates electrical signals between the device 106 and the mating connector 108.

The connector assembly 104 includes a housing 112 having a mating interface 114. The housing 112 may include an upper body 122 and a lower body 124. Alternatively, the housing 112 may be formed as a unitary body. The housing 112 engages an end 116 of the mating connector 108 through the mating interface 114. Several connectors 118 are aligned in the housing 112 to receive contacts 120 of the mating connector 108. The connectors 118 are coupled with several cables 126. A different number of cables 126 may be included than those shown in FIG. 1. The cables 126 may be mounted to another device or substrate 128, such as a circuit board. The cables 126 may electrically connect the connectors 118 with conductive pathways 130 in the substrate 128. For example, the cables 126 may electrically couple the connectors 118 with the conductive pathways 130 to communicate signals and to electrically couple the connectors 118 to an electrical ground. In one embodiment, the conductive pathways 130 include traces in a circuit board.

As described below, the connectors 118 include shields 200 (shown in FIG. 2) that are electrically coupled to a cable shield 306 (shown in FIG. 3) of the cable 126 by a coupling that is not an IDC. For example, one or more resistance welds 500-504 (as discussed below in more detail in connection with FIG. 5) may be used to electrically and mechanically couple the shields 200 and the cable shields 306. The use of a connection that is not an IDC, or a non-IDC, to electrically and mechanically couple the shield 200 and the cable shield 306 provides a conductive pathway between the shield 200 and the cable shield 306 without altering the shape or geometry of the cable shield 306. As a result, the resistance welds 500-504 do not cause a significant increase in the impedance of the cable shield 306. Moreover, the use of resistance welds 500-504 to couple the shield 200 and cable shields 206 may result in a more consistent and repeatable electrical and mechanical connection between the shield 200 and cable shield 306.

Figure 2:
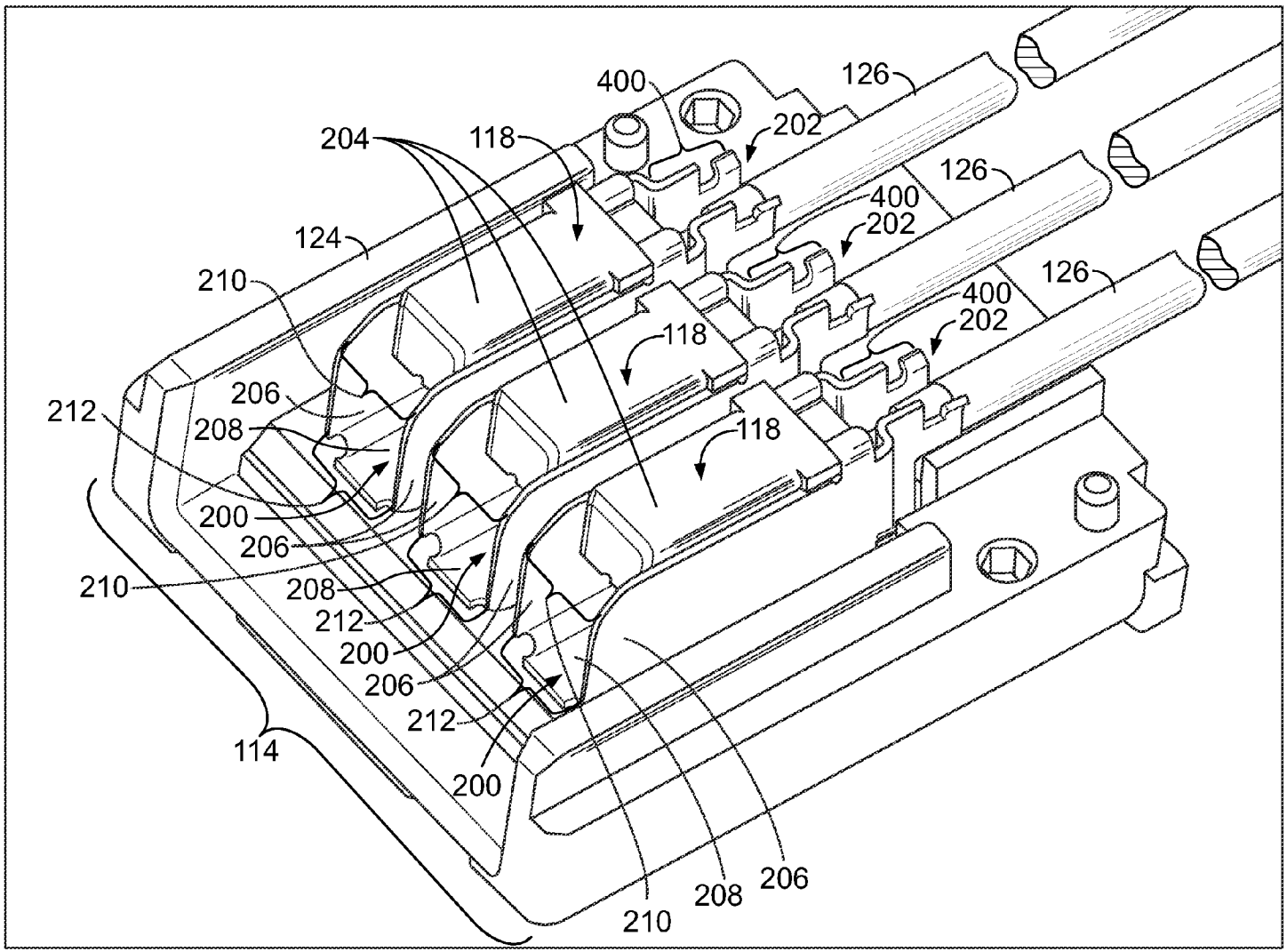
FIG. 2 is a perspective view of a lower body of a housing shown in FIG. 1.

FIG. 2 is a perspective view of the lower body 124 of the housing 112 and the connectors 118. The connectors 118 are held side-by-side in the housing 112 in the illustrated embodiment, although a different number of connectors 118 may be included in the housing 112. The connectors 118 include dielectric bodies 204 received within corresponding ones of the shields 200. The connectors 118 include contacts 300 (shown in FIG. 3) that are held by the dielectric bodies 204 in the shields 200. The contacts 300 engage the mating contacts 120 (shown in FIG. 1) of the mating connector 108 (shown in FIG. 1) to electrically couple the mating connector 108 and the connector assembly 104 (shown in FIG. 1). For example, the device 106 (shown in FIG. 1) may communicate electronic signals with the substrate 128 (shown in FIG. 1) via an electrically conductive pathway extending through the device cable 110, the mating connector 108, the connector assembly 104 and the conductive pathways 130 (shown in FIG. 1) of the substrate 128. The dielectric bodies 204 electrically isolate the contacts 300 from the shields 200.

The shields 200 include opposing sidewalls 206 that are joined by a mounting wall 208. The sidewalls 206 are disposed perpendicular to the mounting wall 208 in the illustrated embodiment. The mounting wall 208 engages the lower body 124 of the housing 112 when the shields 200 are mounted to the lower body 124. The sidewalls 206 and the mounting wall 208 extend between a mating interface 212 and a cable cradle 400 of each shield 200. The contacts 120 (shown in FIG. 1) of the mating connector 108 (shown in FIG. 118) are loaded into the connectors 118 and into the shields 200 through the mating interface 212. An open side 210 of each shield 200 is provided opposite the mounting wall 208 such that the shields 200 enclose the dielectric bodies 204 on three sides of the bodies 204.

The shields 200 shield the contacts 300 in the connectors 118 from electromagnetic interference. For example, the shields 200 may each include, or be formed from, a conductive material such as a metal. The conductive shields 200 are electrically coupled to an electric ground of the substrate 128 by the cables 126 (shown in FIG. 1). The electric connection of the shields 200 to the electric ground may reduce electromagnetic interference on the signals communicated using the contacts 300. The cables 126 are loaded into the connectors 118 through a loading end 202 of the connectors 118. The loading end 202 opposes the mating interface 114 of the housing 112 in the illustrated embodiment.

Figure 3:
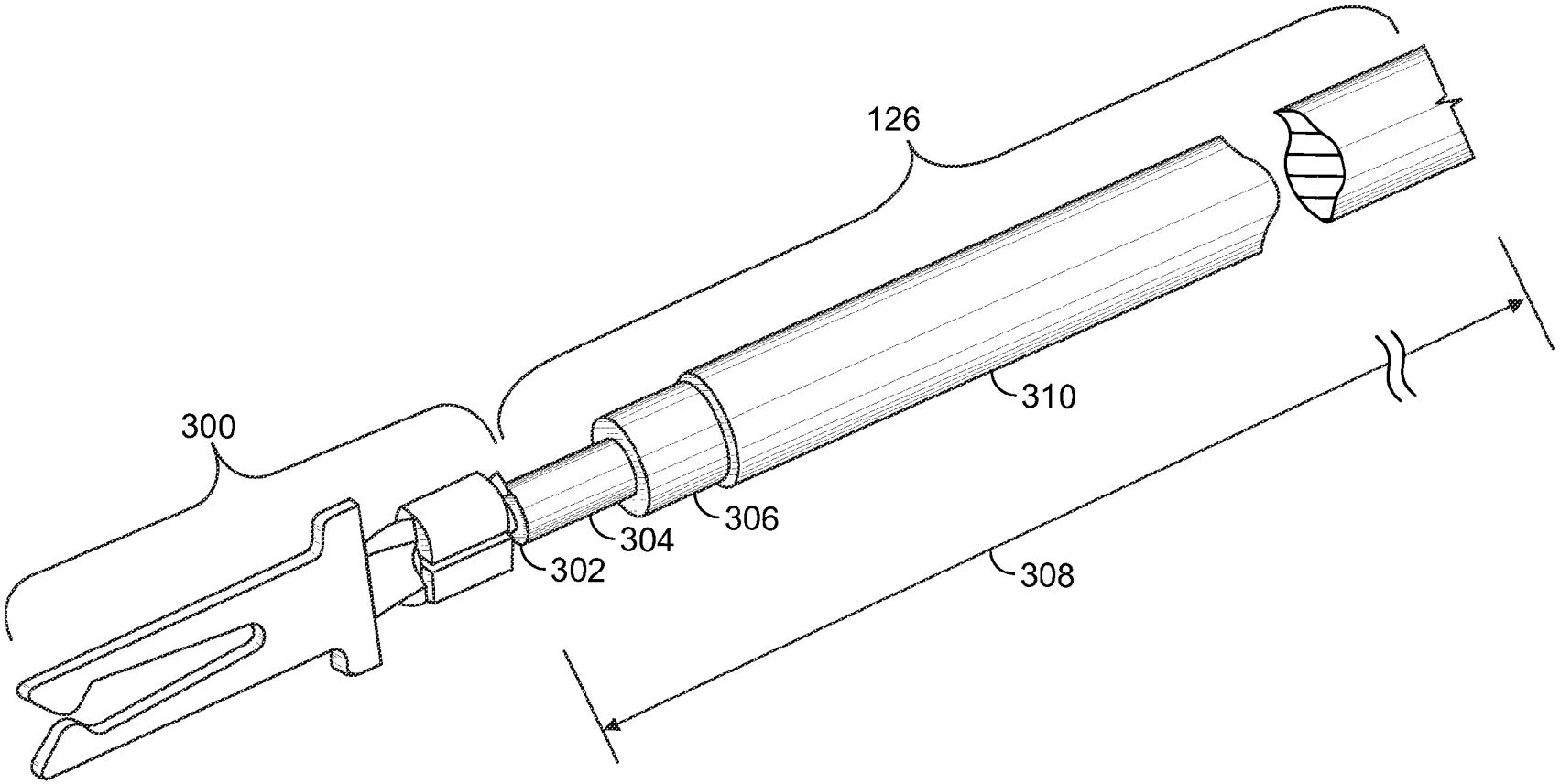
FIG. 3 is a perspective view of a contact and a cable shown in FIG. 1 according to one embodiment.

FIG. 3 is a perspective view of the contact 300 and an end portion of the cable 126 utilized according to one embodiment. The contact 300 includes, or is formed from, a conductive material. For example, the contact 300 may be stamped and formed from a sheet of a metal material. The contact 300 is coupled to the cable 126 to provide a conductive pathway between the contact 300 and the cable 126. The cable 126 extends along a length 308 between the contact 300 and the device or substrate 128 (shown in FIG. 1) to which the cable 126 is mounted. The cable 126 may have a substantially circular cross-section. For example, the cable 126 may have a tubular shape. In the illustrated embodiment, the cable 126 is a coaxial cable. For example, the cable 126 may include a core conductor 302 that is at least partially surrounded by a dielectric spacer 304. The core conductor 302 may include one or more copper wires or wires formed from a metal or metal alloy. The dielectric spacer 304 includes, or is formed from, a nonconducting or insulating material. For example, the dielectric spacer 304 may be formed from a dielectric polymer. The dielectric spacer 304 is at least partially surrounded by a cable shield 306. The dielectric spacer 304 electrically isolates the conductor 302 from the cable shield 306. The cable shield 306 includes, or is formed from, a conductive material. For example, the cable shield 306 may include a plurality of metal wires, a metallic tubular body, or a metallic screen. As described below, the cable shield 306 is electrically connected with an electric ground and the shield 200 (shown in FIG. 2) to electrically couple the shield 200 with the electric ground. The cable shield 306 may shield the conductor 302 from electromagnetic interference. The cable shield 306 is enclosed within a dielectric jacket 310. The dielectric jacket 310 includes, or is formed from, a nonconducting or insulating material. For example, the dielectric jacket, 310 may be formed from a dielectric polymer. The dielectric jacket 310 electrically isolates the cable shield 306 and protects the cable shield 306.

Figure 4:
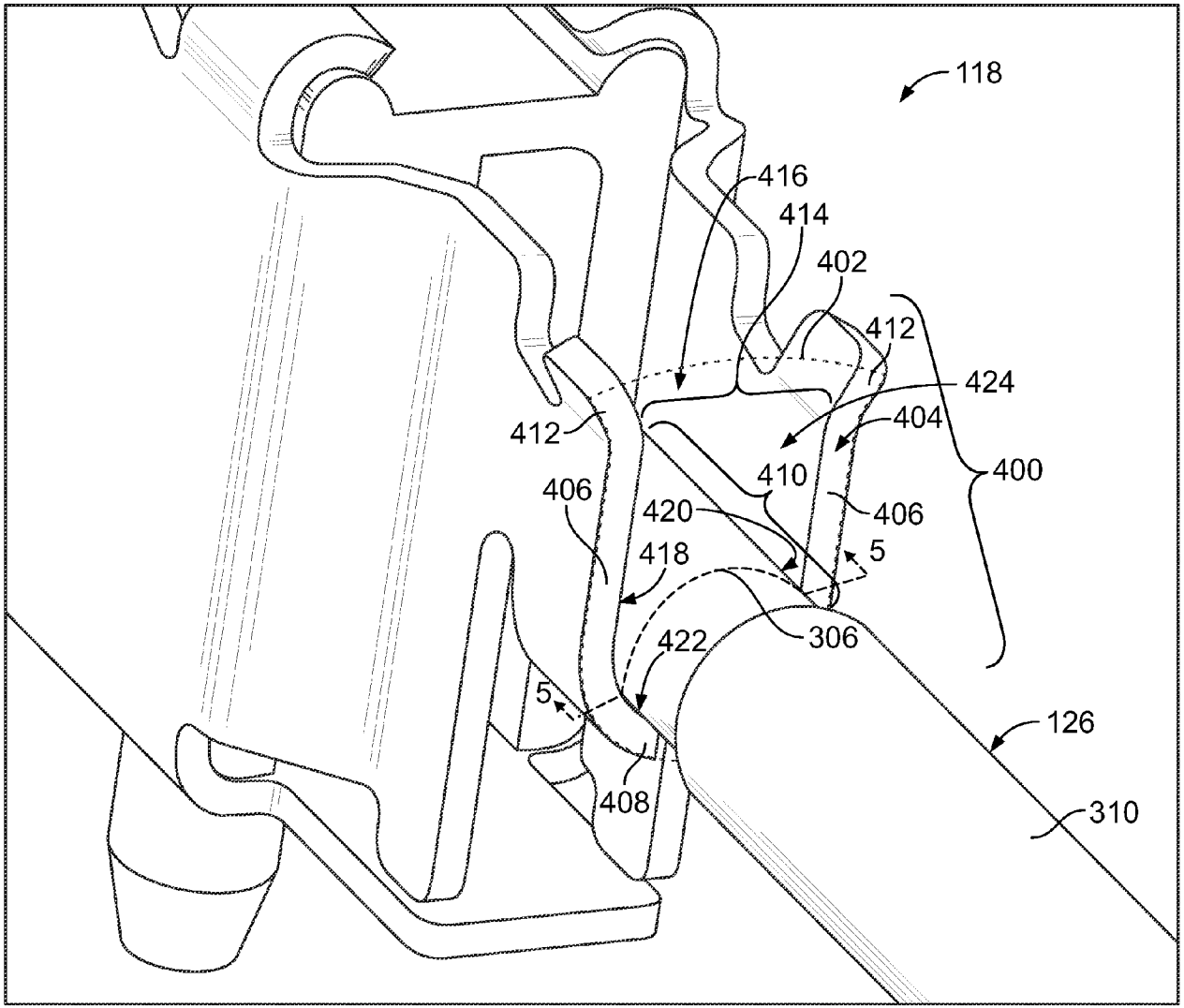
FIG. 4 is a perspective view of a connector shown in FIG. 1 according the one embodiment.

FIG. 4 is an end view of the cable 126 and the loading end 202 of connector 118 of FIG. 2. The shield 200 includes a cradle 400 formed therewith in the illustrated embodiment, the cradle 400 includes opposing sidewalls 406 and a bottom coupling wall 408 that form a shape similar to the letter "U." The sidewalls 406 and coupling wall 408 extend from a loading interface 402 to the sidewalls 206 (shown in FIG. 2) and mounting wall 208 (shown in FIG. 2) of the shield 200. The walls 406, 408 and shield 200 may be a unitary body. For example, the walls 406, 408 may be stamped and formed from a common sheet of metal.

The opposing sidewalls 406 are substantially flat surfaces on opposing sides of the cradle 400. The opposing walls 406 are parallel to one another. Alternatively, the walls 406 may be oriented in directions different from the directions shown in FIG. 4. For example, the walls 406 may be transverse to one another. In another embodiment, one or more of the walls 406 is not substantially flat and may include one or more bends or undulations. The coupling wall 408 is a convex arcuate wall that extends between and interconnects the walls 406 in the embodiment shown in FIG. 4. Alternatively, the coupling wall 408 may have a shape different from the shape shown in the illustrated embodiment. The walls 406 and the coupling wall 408 form a cavity 424. The cavity 424 receives the cable 126 through the loading interface 402 of the shield 200. The loading interface 402 is disposed on an end of the shield 200 that opposes the mating interface 212 (shown in FIG. 2) of the shield 200.

The cradle 400 may include malleable extensions 412 that project upward from an open end 414 of the cradle 400. The extensions 412 are disposed on opposite sides of the open end 414. The open end 414 permits access to the cavity 424 from above the cradle 400. Alternatively, the extensions 412 may be bent or plastically deformed toward one another or toward the open end 414 to at least partially close the open end 414. For example, the extensions 412 may be bent inward toward one another to close the open end 414.

The loading interface 402 includes one end 404 of the shield 200 through which the cable 126 is loaded into the shield 200. A portion 410 of the dielectric jacket 310 of the cable 126 is removed from the cable 126 to expose the cable shield 306 proximate to a loading end 416 of the cable 126. The loading end 416 of the cable 126 includes the end of the cable 126 that is loaded into the shield 200. The exposed cable shield 306 is received in the cradle 400. As described below, resistance welds 500-504 (shown in FIG. 5) may be provided between the cable shield 306 and the cradle 400 to electrically and mechanically couple the cable shield 306 and the cradle 400. Several bonding sites 418-422 are provided between the cable shield 306 and the cradle 400. The bonding sites 418-422 include locations in the cavity 424 where the cable shield 306 and the cradle 400 are disposed close enough to one another to permit a conductive coupling material to electrically and mechanically bond the cable shield 306 and cradle 400 with one another. For example, the bonding sites 418-422 include areas in the cavity 424 where a conductive solder may be placed to couple the cable shield 306 and cradle 400. By way of example only, the bonding sites 418, 420 are disposed between the cable shield 306 and the sidewalls 406 of the cradle 400 on a side of the cable shield 306 that is closer to the open end 414 of the cradle 400 than the coupling wall 408. The bonding site 422 is located below the cable shield 306 between the coupling wall 408 and the cable shield 306.

Figure 5:
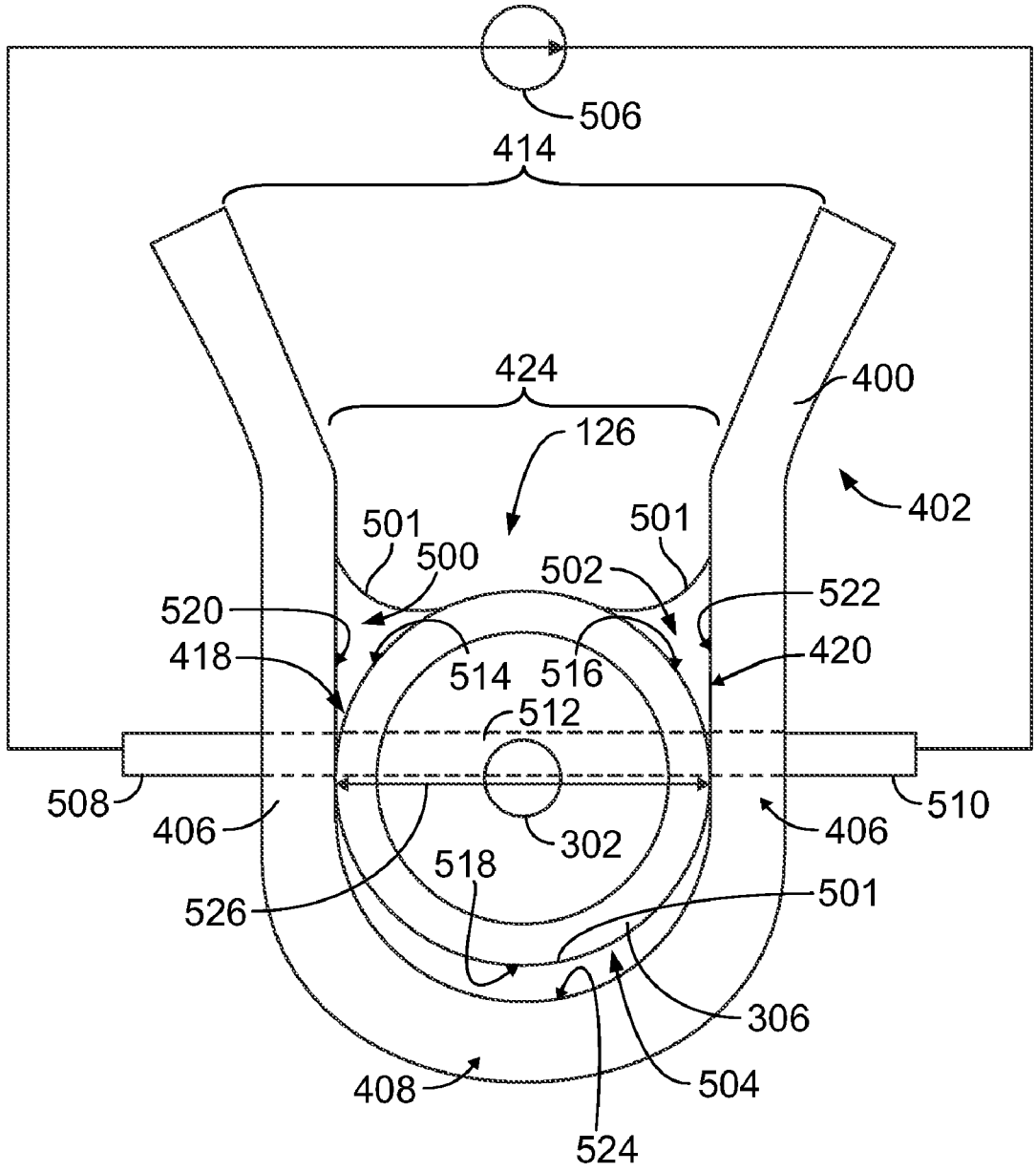
FIG. 5 is a cross-sectional view of the cable shown in FIG. 1 taken along line 5-5 in FIG. 4 and an elevational view of a loading interface of a cradle shown in FIG. 4.

FIG. 5 is a cross-sectional view of the cable 126 taken along line 5-5 in FIG. 4 and an elevational view of the loading interface 402 of the cradle 400. The cable 126 is electrically and mechanically connected to the cradle 400 using the exemplary resistance welds 500-504. A conductive coupling material 501 is placed in the cavity 424. For example, a conductive solder is placed in the cavity 424. The conductive coupling material 501 may be placed in the cavity 424 through the open end 414 of the cradle 400. Alternatively, the conductive coupling material 501 is placed in the cavity 424 through the loading interface 402. The conductive coupling material 501 may be placed in the bottom bonding site 422 (shown in FIG. 4) prior to loading the cable shield 306 into the cradle 400. The cable shield 306 is then loaded into the cradle 400 through the loading interface 402 or through the open end 414. Additional conductive coupling material 501 may be placed adjacent to one or more of the cable shield 306 and the sidewalls 406 of the cradle 400 at the top bonding sites 418, 420 (shown in FIG. 4). Optionally, the conductive coupling material 501 is not placed in the bottom bonding site 422. In another example, the conductive coupling material 501 may be placed on the cable shield 306 prior to loading the cable shield 306 into the cradle 400. The conductive coupling material 501 may be applied to the cable shield 306 around all or a portion of the circumference of the cable shield 306 prior to placing the cable shield 306 in the cradle 400. For example the cable shield 306 may be dipped in the conductive coupling material 501 prior to placing the cable shield 306 into the cradle 400. In an alternative embodiment, no conductive coupling material 501 is applied to the cable shield 306 or to the cradle 400. For example, the cable shield 306 may be loaded into the cradle 400 with no conductive coupling material 501 disposed on or between either the cable shield 306 and the cradle 400.

An electric current 512 is applied through the cradle 400 and the cable shield 306 to cause the conductive coupling material 501 to flow. For example, a plurality of electrodes 508, 510 may be electrically connected to a current source 506. The current source 506 may include an oscillating current source or a constant current source. The electrodes 508, 510 are pressed against the opposing sidewalls 406 of the cradle 400 as shown in FIG. 5. The current 512 is applied at the sidewalls 406 of the cradle 400 by the electrodes 508, 510. The current 512 passes through the cradle 400 and the cable shield 306. The current 512 heats the conductive coupling material 501 in the cavity 424. The current 512 also may heat one or more of the cable shield 306 and the cradle 400. The impedance characteristic of the cradle 400 and the cable 126 may cause the level of thermal energy, and thus heat, in and around the cradle 400 to increase. As the heat in and around the cradle 400 increases the conductive coupling material 501 flows. For example, the conductive coupling material 501 may have a melting temperature that is less than the melting temperature of the various components of the cable 126 and the shield 200 (shown in FIG. 2). The conductive coupling material 501 may flow similar to a liquid. The conductive coupling material 501 flows between the cable shield 306 and the cradle 400 to wet the cable shield 306 and the cradle 400. For example, the conductive coupling material 501 flows to contact the surfaces 514-518 of the cable shield 306 in the bonding sites 418-422 (shown in FIG. 4). The conductive coupling material 501 flows to contact the surfaces 520-524 of the sidewalls 406 and the coupling wall 408 in the bonding sites 418-422. The current 512 is removed from the cradle 400 and cable shield 306 by removing the electrodes 508, 510 from the sidewalls 406 or by stopping the flow of the current 512 from the current source 506. The cradle 400, cable shield 306 and conductive coupling material 501 cool after the current 512 is removed. As the conductive coupling material 501 cools, the material 501 solidifies. The material 501 solidifies to form the resistance welds 500-504 shown in FIG. 5. The resistance welds 500-504 mechanically secure the cable shield 306 and the shield 200 together and electrically connect the cable shield 306 to the shield 200.

In an alternative embodiment, the cable shield 306 is bonded to the cradle 400 without the use of the conductive coupling material 501, as described above. For example, a resistance weld may be formed between the cable shield 306 and the cradle 400 without the use of the conductive coupling material 501. The cable shield 306 may be placed in the cradle 400 with no conductive coupling material 501 applied to either of the cable shield 306 and the cradle 400. The current 512 is applied to the cradle 400, as described above. The current 512 may heat one or more of the cable shield 306 and the cradle 400 enough to couple the cable shield 306 and the cradle 400. For example, the cable shield 306 may partially melt and bond with the cradle 400. The bond between the cradle 400 and the cable shield 306 may provide an electrical and mechanical connection between the cradle 400 and the cable shield 306.

While the current 512 is schematically illustrated as a direct connection between the electrodes 508, 510 in FIG. 5, the current 512 may deviate or extend from the path shown in FIG. 5. For example, the current 512 may extend into the cradle 400, shield 200, cable conductor 302, cable shield 306, and the like, a greater amount than shown in FIG. 5. The illustration of the current 512 in FIG. 5 is provided merely as an example of the current 512 extending between the electrodes 508, 510. In one embodiment, the current 512 is applied at substantially flat surfaces of the shield 200. For example, the current 512 may be applied by placing, the electrodes 508, 510 in contact with the opposing and substantially flat walls 406 of the cradle 400. The flat walls 406 may provide desirable surfaces on which to apply the current 512 in order to create the resistance welds 500.

Applying the current 512 to create the resistance welds 500-504 does not significantly alter the shape or geometry of the cable 126 or the cable shield 306. For example, the resistance welds 500-504 may not alter the geometry or cross-sectional circular shape of the cable shield 306. An outside diameter 526 of the cable shield 306 may be approximately the same after applying the current 512 to create the resistance welds 500-504. In another example, the cross-sectional circular shape of the cable shield 306 may be maintained and not altered by creating the resistance welds 500-504. The cross-sectional circular shape of the cable shield 306 may remain circular with no indentations, undulations, or other discontinuities caused by the bonding of the cable shield 306 to the shield 200 (shown in FIG. 2) or cradle 400. The final geometry of the cable shield 306 after bonding the cable shield 306 to the cradle 400 is approximately the same as the geometry of the cable shield 306 prior to bonding the cable shield 306 to the cradle 400. Using the resistance welds 500-504 to electrically couple the cable shield 306 and the shield 200 does not significantly alter the impedance of the cable 126 and the cable shield 306. The shield 200 may be electrically connected to an electrical ground by the cable shield 306 to shield the contact 300 (shown in FIG. 3) from electromagnetic interference.

Figure 6:
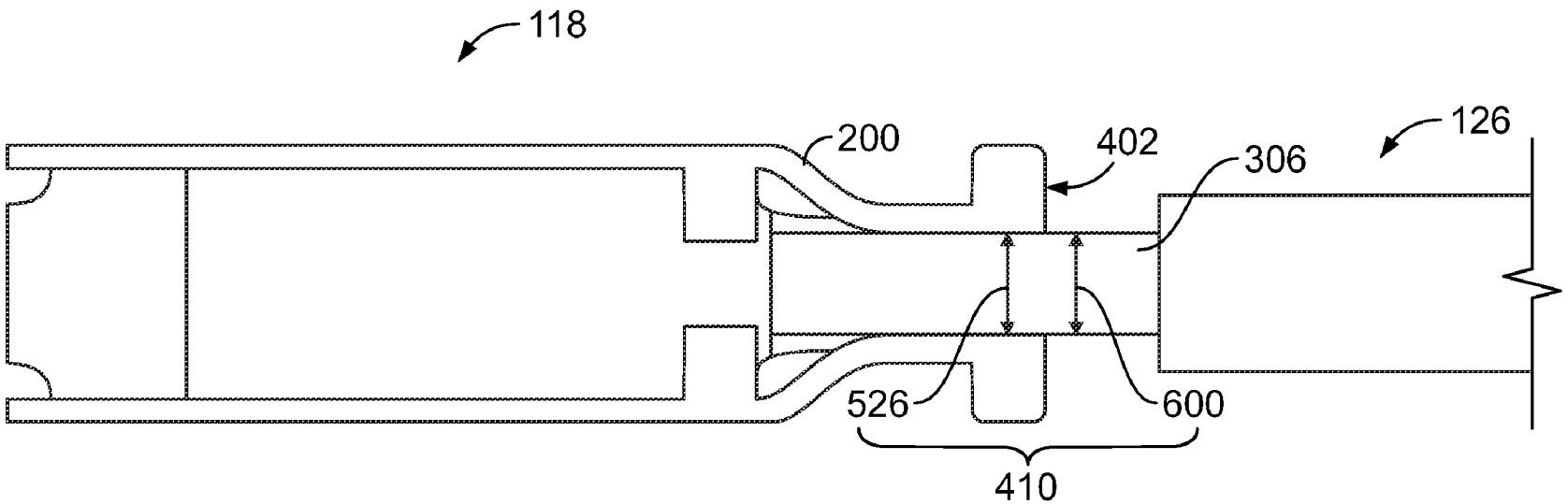
FIG. 6 is a plan view of the connector and the cable shown in FIG. 1.

FIG. 6 is a plan view of the connector 118 and the cable 126. The cable shield 306 extends into the shield 200 through the loading interface 402, as described above. The diameter 526 of the cable shield 306 inside the shield 200 is approximately the same, as an outer diameter 600 of the cable shield 306 outside of the shield 200. For example, the diameters 526, 600 of the cable shield 306 may be the same inside the shield 200 and outside of the shield 200 proximate to the loading interface 402. In one embodiment, the diameter 600 of the cable shield 306 is the outer diameter of the cable shield 306 in the exposed portion 410 of the cable 126 that is located outside of the shield 200.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §1102, sixth paragraph, unless and until such claim limitations expressly use the phrase "means for" followed by a statement of function void of further structure.

What is claimed is:

1. A connector assembly comprising:

a cable comprising a conductor and a cable shield at least partially surrounding the cable conductor, the cable shield configured to be connected to an electrical ground;

a connector including a contact and a shield, the shield comprising conductive walls and a cradle, the walls extending from a mating interface to the cradle and at least partially surrounding the contact, the mating interface configured to receive a mating connector, the cradle comprising sidewalls interconnected by a coupling wall, the sidewalls and coupling wall extending from a loading interface toward the mating interface and shaped to receive the cable through the loading interface; and a resistance weld disposed between the cable shield and the coupling wall of the cradle and electrically coupling the shield to the cable shield, wherein the shield of the connector is electrically connected to the electrical ground by the resistance weld and the cable shield, and the cable shield is electrically coupled to the shield of the connector without crimping the cable shield.

2. The connector assembly of claim 1, wherein the resistance weld comprises conductive solder disposed between the cable shield and the sidewalls of the cradle.

3. The connector assembly of claim 1, wherein the cable shield is electrically connected to the cradle without deforming the cable shield.

4. The connector assembly of claim 1, wherein an outer diameter of the cable shield is approximately the same inside the cradle and outside of the shield in a location proximate to the loading interface of the cradle.

5. The connector assembly of claim 1, further comprising at least three of the resistance welds, the resistance welds disposed between the cable shield and each of the sidewalls of the cradle and between the cable shield and the coupling wall.

6. The connector assembly of claim 1, wherein the coupling wall comprises a convex arcuate wall shaped to receive the cable shield.

7. The connector assembly of claim 1, wherein the mating and loading interfaces oppose one another.

8. The connector assembly of claim 1, wherein the conductive walls of the shield comprise a plurality of opposing walls interconnected by a mounting wall, the mounting wall configured to be mounted to a connector housing to secure the shield in the connector housing.

9. The connector assembly of claim 1, wherein the resistance weld includes conductive solder disposed in a space between the cable and the coupling wall of the cradle.

10. The connector assembly of claim 1, wherein the resistance weld is a first resistance weld and the cable shield engages the cradle at interfaces on opposite sides of the cable shield, further comprising a second resistance weld between the cable shield and the cradle above at least one of the interfaces such that the at least one of the interfaces is between the first and second resistance welds.

11. The connector assembly of claim 10, further comprising a third resistance weld between the cable shield and the cradle above another one of the interfaces between the cable shield and the cradle such that the another one of the interfaces is disposed between the third resistance weld and the first resistance weld.

12. A connector assembly comprising:

a cable comprising a conductor and a cable shield at least partially surrounding the cable conductor, the cable shield configured to be connected to an electrical ground;

a connector including a contact and a shield, the shield comprising conductive walls and a cradle, the walls extending from a mating interface to the cradle and at least partially surrounding the contact to shield the contact from electromagnetic interference, the mating interface configured to receive a mating connector to mate the connector and mating connector, the cradle comprising sidewalls interconnected by a coupling wall, the sidewalls and coupling wall extending from a loading interface toward the mating interface and shaped to receive the cable through the loading interface; and resistance welds between the cable shield and the cradle, the resistance welds electrically coupling the shield to the cable shield without deforming the cable shield such that an outer diameter of the cable shield is approximately the same inside the cradle and outside of the shield in a location that is proximate to the loading interface, the resistance welds disposed between the cable shield and each of the sidewalls of the cradle and between the cable shield and the coupling wall of the cradle.

13. The connector assembly of claim 12, wherein the resistance welds comprise conductive solder disposed in spaces between each of the sidewalls of the cradle and the cable shield and in a space between the coupling wall and the cable shield.

14. The connector assembly of claim 12, wherein the sidewalls of the cradle oppose one another and the resistance welds couple the cable shield and the cradle by applying an electric current through the cable shield and the cradle at the sidewalls.

15. The connector assembly of claim 12, wherein the cradle comprises an opening that opposes the coupling wall, the opening extending between the sidewalls of the cradle.

16. The connector assembly of claim 12, wherein the mating and loading interfaces oppose one another.

17. The connector assembly of claim 12, wherein the conductive walls of the shield comprise a plurality of opposing walls interconnected by a mounting wall, the mounting wall configured to be mounted to a connector housing.

18. The connector assembly of claim 12, wherein the cable shield is electrically coupled with the shield without crimping the cable shield.

19. The connector assembly of claim 12, wherein the cable shield engages the cradle at interfaces on opposite sides of the cable shield and the resistance welds are disposed between the cable shield and the cradle on opposite sides of the interfaces.

* * * * *